US008376309B2

(12) United States Patent
Merriam

(10) Patent No.: US 8,376,309 B2
(45) Date of Patent: Feb. 19, 2013

(54) ADJUSTABLE FORM FOR A CONCRETE STAIRWAY

(75) Inventor: Jere Merriam, Bristol, CT (US)

(73) Assignee: D'Amato Construction Corporation, Inc., Bristol, CT (US)

( * ) Notice: Subject to any disclaimer, the term of this patent is extended or adjusted under 35 U.S.C. 154(b) by 214 days.

(21) Appl. No.: 12/870,310

(22) Filed: Aug. 27, 2010

(65) Prior Publication Data

US 2011/0240831 A1 Oct. 6, 2011

Related U.S. Application Data

(60) Provisional application No. 61/320,957, filed on Apr. 5, 2010.

(51) Int. Cl.
*E04G 13/06* (2006.01)

(52) U.S. Cl. ..... 249/14

(58) Field of Classification Search ..... 249/14; *E04G 13/06; B28B 7/22*
See application file for complete search history.

(56) References Cited

U.S. PATENT DOCUMENTS

| | | | | | |
|---|---|---|---|---|---|
| 771,225 | A * | 10/1904 | Bellville | 33/420 |
| 1,106,627 | A * | 8/1914 | Cornelius | 249/14 |
| 1,153,462 | A * | 9/1915 | Stubblefield | 249/14 |
| 1,173,066 | A * | 2/1916 | Vandegrift | 249/14 |
| 1,319,385 | A * | 10/1919 | Gottschalk | 249/208 |
| 2,548,703 | A * | 4/1951 | Cline | 249/14 |
| 3,823,910 | A * | 7/1974 | Crozier | 249/14 |
| 4,775,131 | A * | 10/1988 | Baumgartner | 249/208 |
| 4,916,796 | A | 4/1990 | Baumgartner | |
| 5,133,530 | A | 7/1992 | Thorsen | |
| 6,354,403 | B1 | 3/2002 | Truckner et al. | |
| 6,860,460 | B2 | 3/2005 | Rellergert | |
| 8,262,055 | B2 * | 9/2012 | Costello et al. | 249/14 |
| 2009/0266970 | A1 | 10/2009 | Sladojevic | |

FOREIGN PATENT DOCUMENTS

| | | |
|---|---|---|
| DE | 19546050 | * 12/1996 |
| DE | 19816720 | * 7/1999 |
| WO | WO2008033037 | * 3/2008 |

* cited by examiner

*Primary Examiner* — Michael Safavi
(74) *Attorney, Agent, or Firm* — O'Shea Getz P.C.

(57) ABSTRACT

An apparatus for forming steps within a concrete stairway, wherein each step has a rise and a run. The apparatus includes a stringer rail, one or more riser brackets and a plurality of fasteners. The stringer rail has a lengthwise-extending channel. Each riser bracket has a panel leg and a support leg, wherein one end of the support leg is attached to panel leg. The fasteners are selectively slidable within the rail channel. One of the fasteners attaches the panel leg to the rail and another of the fasteners attaches the support leg to the rail. Each fastener is configurable in a first mode where the fastener is slidably attached to the rail. Each fastener is configurable in a second mode where the fastener is fixedly attached to the rail.

11 Claims, 6 Drawing Sheets

ADJUSTABLE FORM FOR A CONCRETE STAIRWAY

This application claims priority to U.S. Provisional Patent Application No. 61/320,957 filed on Apr. 5, 2010.

BACKGROUND OF THE INVENTION

1. Technical Field

The present invention relates to concrete forms in general, and to adjustable reusable devices for forming concrete stairs in particular.

2. Background Information

Concrete stairs are a desirable, durable, and relatively inexpensive option for providing pedestrian access between different elevations. As can be seen in FIG. 1, concrete stairways 12 typically include one or more steps 14, each having a riser 16 and a tread 18. The riser 16 extends from bottom end 20 to a top end 22 defining a rise 24. The riser 16 is arranged substantially parallel to, or slightly offset by an angle $\alpha$ (e.g., 1 to 5 degrees) from, a vertical plane (e.g., a y-z plane). A tread 18 may be described as extending from the top end 22 of the riser 16 to a distal end 26 (e.g., a bottom end 20 of a riser 16 in an adjacent step 14) defining a run 28. The tread 18 is arranged offset by an angle $\beta$ from the riser 16 (e.g., $90°-\alpha$). In embodiments where the treads 18 are substantially parallel to the horizontal plane, the angles $\alpha$ and $\beta$ are typically complementary.

One of the drawbacks to concrete stairways is that they are difficult to properly produce, particularly if the stairway is wide and has a large number of steps. The concrete is initially in a semi-liquid state and must be held in place by a form. If the stairway is large enough, the semi-liquid concrete will present a substantial load on the form, and will need to be vibrated during the forming process to ensure the concrete is properly settled. The vibration typically present an additional loading on the forms. As the concrete cures, the exposed surfaces of the concrete must be carefully finished to provide the desired surface texture. In many instances, concrete stairs produced on a build-site are custom formed from lumber, which forms are discarded after the single use. This manner of forming a concrete stair is consequently time-consuming, expensive, and has a substantial risk of error (e.g., forms not assembled correctly vis-à-vis dimensions, forms deflect/warp or break under load, etc. Currently available devices for forming stairs have not met commercial success. These devices often have limited configurability, or are difficult to use, or impede the user's ability to access the concrete during the pour and finishing thereafter, or some combination thereof.

What is needed is a device that can be used to form concrete stairs, one that is reusable, one that can handle the loads associated with large stairs, one that facilitates the pour and finishing of the stairs, and one that is easily configurable to handle a variety of different stair configurations.

SUMMARY OF THE DISCLOSURE

According to an aspect of the invention, an apparatus is provided for forming steps within a concrete stairway, wherein each step has a rise and a run. The apparatus includes at least a pair of stringer rails, a plurality of riser brackets, and a plurality of fasteners. Each rail has a lengthwise-extending channel. Each riser bracket has a panel leg and a support leg, wherein one end of the support leg is attached to panel leg. The fasteners are selectively slidable within the rail channel. One of the fasteners attaches the panel leg to the rail and another of the fasteners attaches the support leg to the rail.

Each fastener is configurable in a first mode where the fastener is slidably attached to the rail. Each fastener is configurable in a second mode where the fastener is fixedly attached to the rail.

According to another aspect of the present invention, the apparatus further includes a lateral brace that extends between the rails, and is attachable to each rail. The lateral brace has a length that may be adjustable to accommodate different staircase widths.

The present invention stair forming apparatus provides several advantages over the prior art. For example, it is reusable and is easily configurable to handle a variety of different stair configurations; e.g., different rise/run, number of stairs, staircase width, etc. The present device can readily handle the loads associated with large stairs. For example, the amount of concrete necessary for a wide staircase with a large number of stairs can cause prior art devices to bow and otherwise distort, particularly in the middle of the wide stair. With the present device, additional stringer rails and lateral braces can be added to accommodate the load, with each rail attached to each brace. Such an application also illustrates another advantage of the present invention, namely that it facilitates the pour and finishing of the stairs. Specifically, during the pouring and finishing processes, the user can support himself on the lateral braces without altering the form configuration and have easy access to the concrete for pouring and finishing and removal of riser panels.

The foregoing features and the operation of the invention will become more apparent in light of the following description and the accompanying drawings.

DETAILED DESCRIPTION OF THE INVENTION

Figure 2:
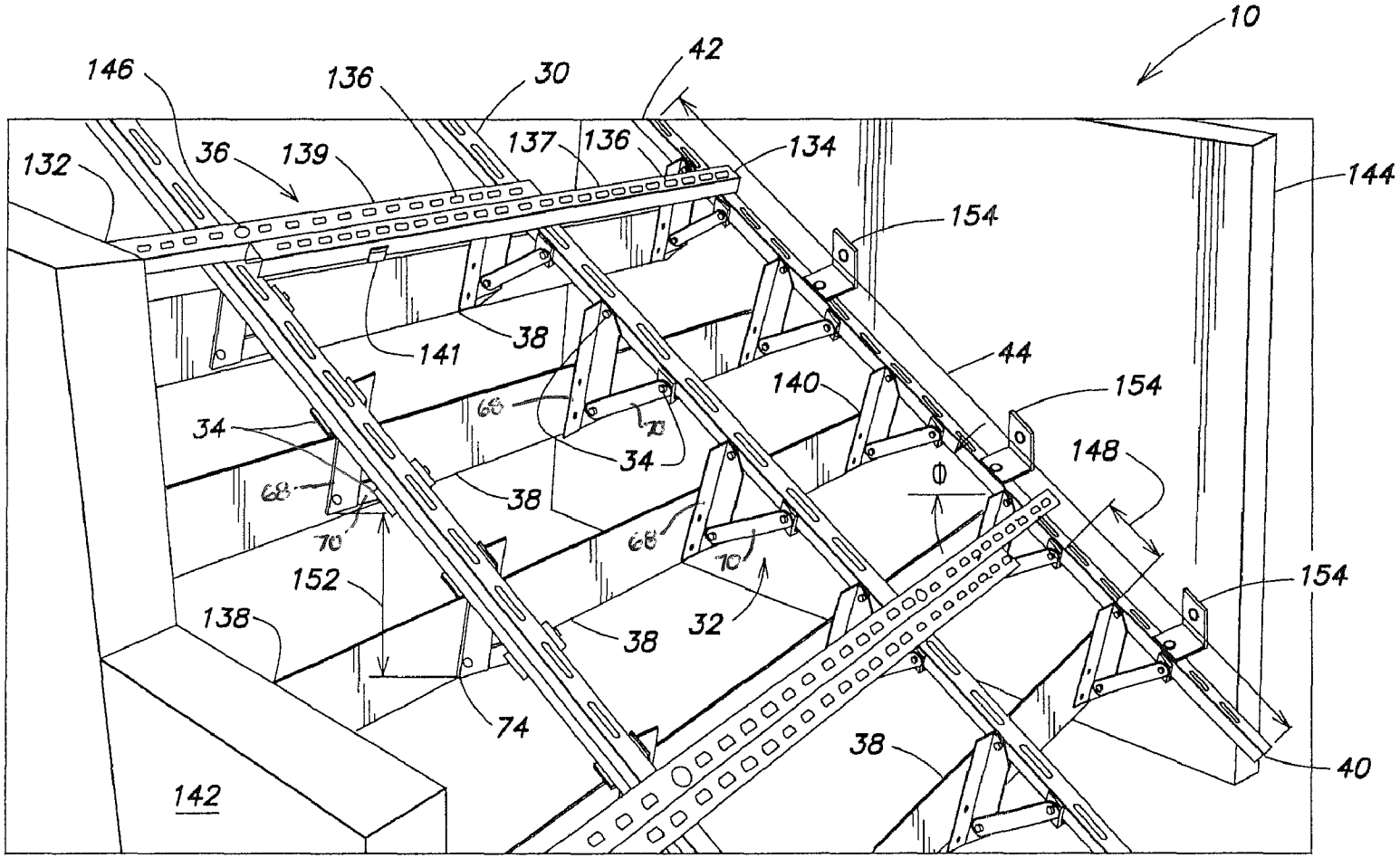
FIG. 2 is a perspective diagrammatic illustration of the present invention stair forming apparatus.

Referring to FIG. 2, an adjustable concrete form 10 is provided operable to form a poured concrete stairway 12. The adjustable concrete form 10 includes a plurality of stringer rails 30, a plurality of riser brackets 32, a plurality of fasteners 34 and, optionally, one or more adjustable lateral brace 36 and one or more riser panels 38. The adjustable concrete form 10 can be used with a variety of site conditions, cheek walls, etc.

Figure 4:
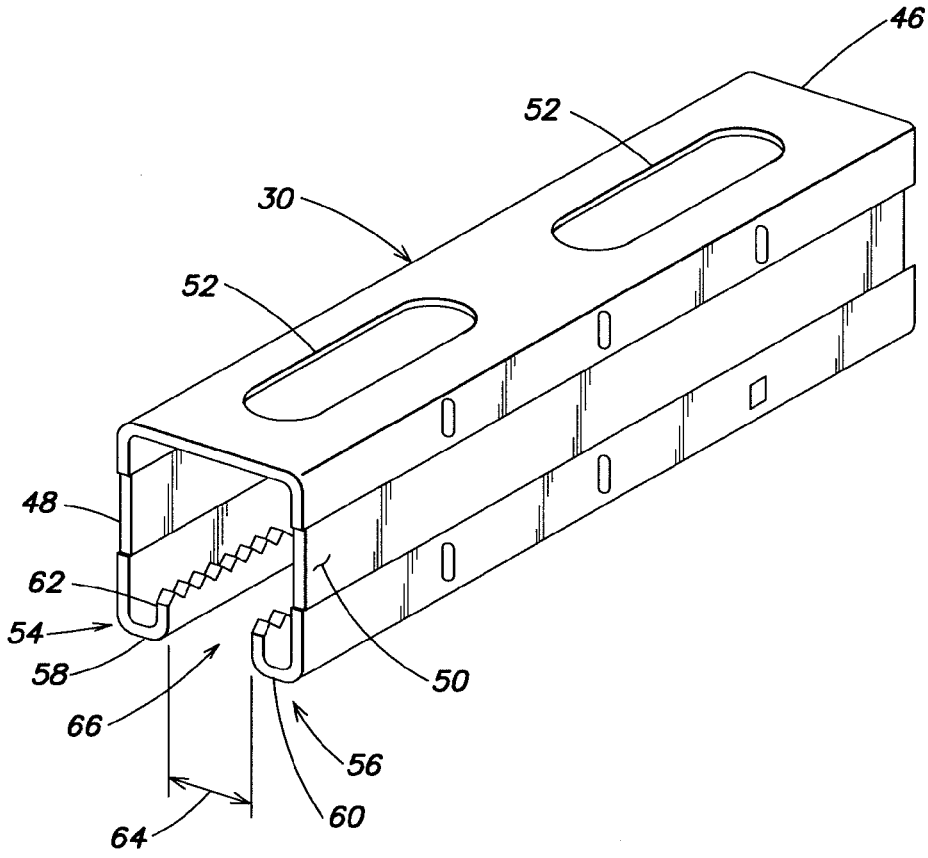
FIG. 4 is a perspective diagrammatic illustration of a section of a rail portion of the present invention stair forming apparatus.
Figure 5:
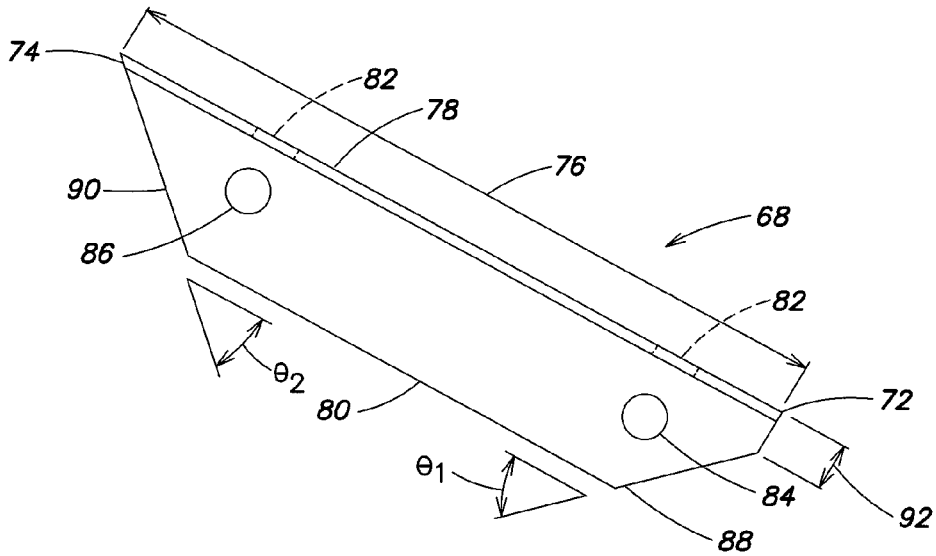
FIG. 5 is a diagrammatic illustration of a panel leg included in the adjustable concrete form in FIG. 3.
Figure 6:
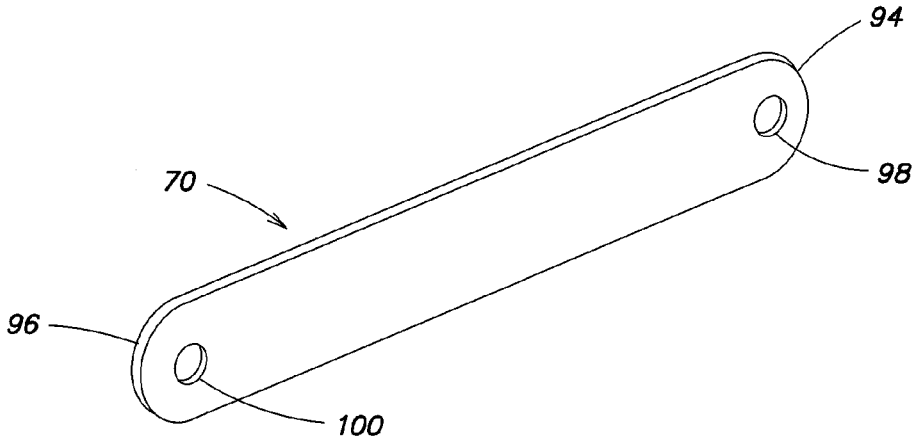
FIG. 6 is a diagrammatic illustration of a support leg included in the adjustable concrete form in FIG. 3.

Each stringer rail 30 extends between a bottom end 40 and a top end 42, defining a length 44 extending therebetween. As can be seen in FIG. 4, each stringer rail 30 includes a mid section 46 (e.g., a brace mounting section) extending between a first sidewall 48 and a second sidewall 50. In preferred embodiments, the mid section 46 includes one or more brace fastener apertures 52, which apertures 52 are typically either circular or elongated. The first and the second sidewalls 48 and 50 extend in parallel from the mid section 46 to respective distal ends 54 and 56. The distal ends 54 and 56 of the first and the second sidewalls 48 and 50 each include an inwardly extending flange 58, 60. In some embodiments, each flange 58,60 has a plurality of detents (e.g., teeth) disposed along a flange lip 62. The flanges 58,60 of the first and the second sidewalls 48 and 50 are separated by a distance 64 defining a channel 66 therebetween. The channel 66 extends lengthwise between the bottom and the top ends 40,42 of the stringer rail 30. An example of a suitable rail is a length of the MQ series, slotted stainless steel channel manufactured by Hilti Corporation. The present invention, however, is not limited to any particular type of rail.

Referring to FIGS. 3-6, each riser bracket 32 includes a panel leg 68 and a support leg 70. The panel leg 68 extends between a top end 72 and a bottom end 74 defining a length 76 (see FIG. 5). The panel leg 68 includes a first mounting section 78 and a second mounting section 80. The first mounting section 78 typically includes at least one riser panel fastener aperture 82. The second mounting section 80 includes a rail fastener aperture 84 and a support leg fastener aperture 86. The rail fastener aperture 84 is disposed proximate the top end 72 of the panel leg 68. The support fastener aperture 86 is disposed proximate the bottom end 74 of the panel leg 68. The panel leg 68 may be formed from a length of angle iron, where the first mounting section 78 is perpendicular to the second mounting section 80. Further, the top end 72 and/or the bottom end 74 of the second mounting section 80 can each include an acute edge 88, 90. The acute edge 88 of the top end 72 of the second mounting section 80 is disposed a distance 92 from first mounting section 78, and is offset by an angle $\theta_1$ relative to the length 76 of the panel leg 68. The acute edge 90 of the bottom end 74 of the second mounting section 80 is offset by an angle $\theta_2$ relative to the length 76 of the panel leg 68. The present invention, however, is not limited to the aforesaid configuration. In other embodiments, the panel leg can be constructed from, for example, a length of the MQ series, slotted stainless steel channel manufactured by Hilti Corporation. The support leg 70 extends between a first end 94 and a second end 96. The support leg 70 includes a panel leg fastener aperture 98 and a rail fastener aperture 100. The panel leg fastener aperture 98 is disposed proximate the first end 94 of the support leg 70. The rail fastener aperture 100 is disposed proximate the second end 96 of the support leg 70.

The bottom end 74 of the panel leg 68 is pivotally attached to the first end 94 of the support leg 70. For example, a bolt 102 can be inserted through the support leg fastener aperture 86 of the panel leg 68 and the panel leg fastener aperture 98 of the support leg 70, and loosely secured with a nut 104 (see FIG. 3).

Figure 7:
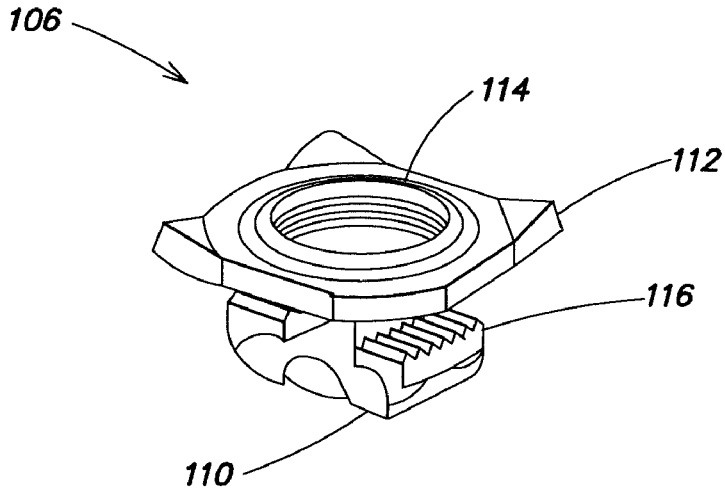
FIG. 7 is a perspective diagrammatic illustration of a rail saddle included in the adjustable concrete form in FIG. 3.

Each fastener 34 is adapted to attach one of the riser brackets 32 to a respective one of the stringer rails 30; e.g., the panel leg 68 and a support leg 70 of each riser bracket 32 is attached to the stringer rail 30. In the embodiment in FIG. 3, each fastener 34 includes a rail saddle 106 and a mounting bracket 108. Referring to FIG. 7, the rail saddle 106 includes a clamping element 110 and a slide element 112. The clamping element 110 and the slide element 112 are adapted to clamp the flanges 58 and 60 of the stringer rail 30 between the clamping element 110 and the slide element 112 (e.g., see FIG. 3). In the embodiment in FIG. 7, the clamping element 110 includes a threaded aperture 114 and a plurality of detents 116. The detents 116 are adapted to mate with the detents 62 (see FIG. 4) on the flanges 58 and 60 of each stringer rail 30 (see FIG. 3) for inhibiting lengthwise movement along the stringer rail 30. An example of a suitable rail saddle is the MQA R Pipe Ring Saddle manufactured by Hilti Corporation. The present invention, however, is not limited to any particular rail saddle configuration.

Figure 8:
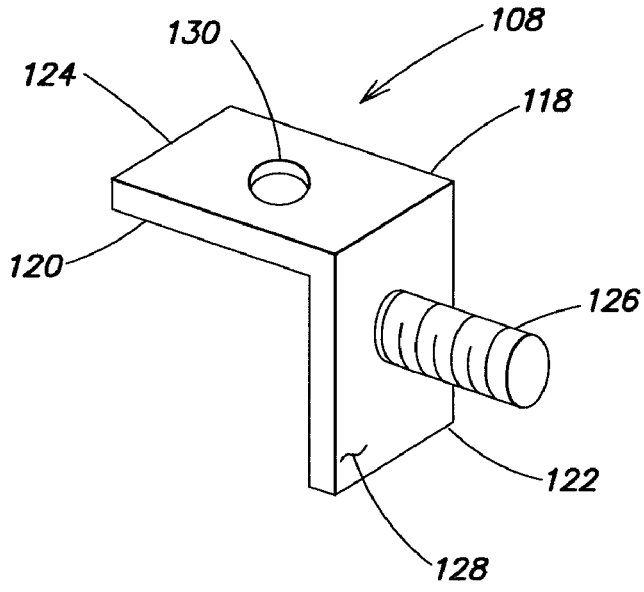
FIG. 8 is a perspective diagrammatic illustration of a mounting bracket included in the adjustable concrete form in FIG. 3.

Referring now to FIG. 8, the mounting bracket 108 extends between two ends 118, 120. The mounting bracket 108 includes a riser bracket mounting section 122 and a saddle mounting section 124. The riser bracket mounting section 122 includes a fastener 126 extending outwardly from an outer surface 128 thereof; i.e., away from the saddle mounting section 124. The saddle mounting section 124 includes a rail saddle fastener aperture 130. The mounting bracket 108 may, for example, be constructed from a length of angle iron, where the riser bracket mounting section 122 is disposed perpendicular to the saddle mounting section 124. The present invention, however, is not limited to the aforesaid configuration.

Figure 3:
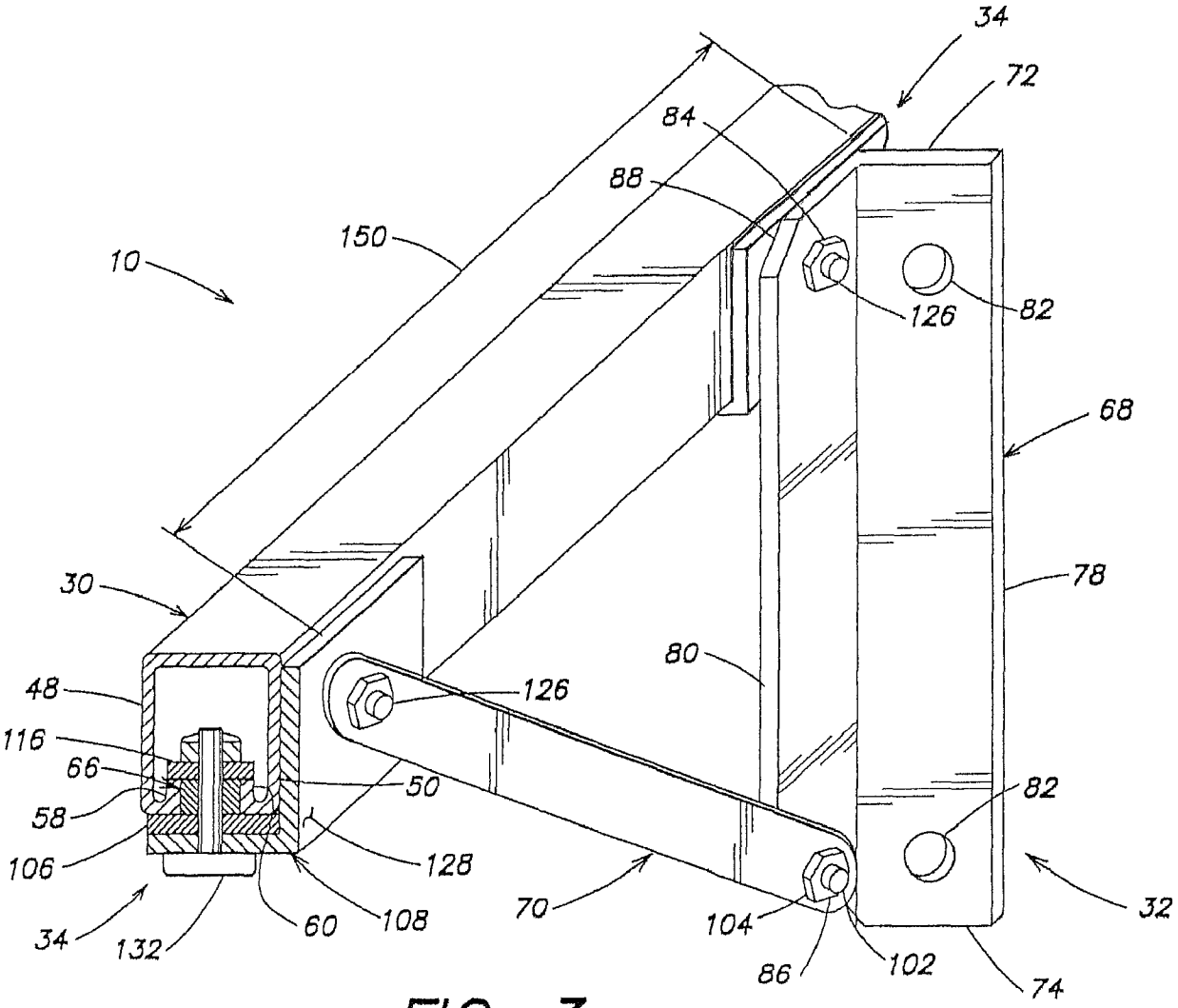
FIG. 3 is a perspective diagrammatic illustration of a portion of the present invention stair forming apparatus.

Referring to FIG. 3, the rail saddle 106 is connected to the saddle mounting section 124 of the mounting bracket 108 via, for example, a bolt 132. Specifically, the bolt 132 extends through the saddle fastener aperture 124 (see FIG. 6B) in the mounting bracket 108 and into the threaded aperture 114 (see FIG. 6A) in the clamping element 110 of the rail saddle 106.

Figure 1:
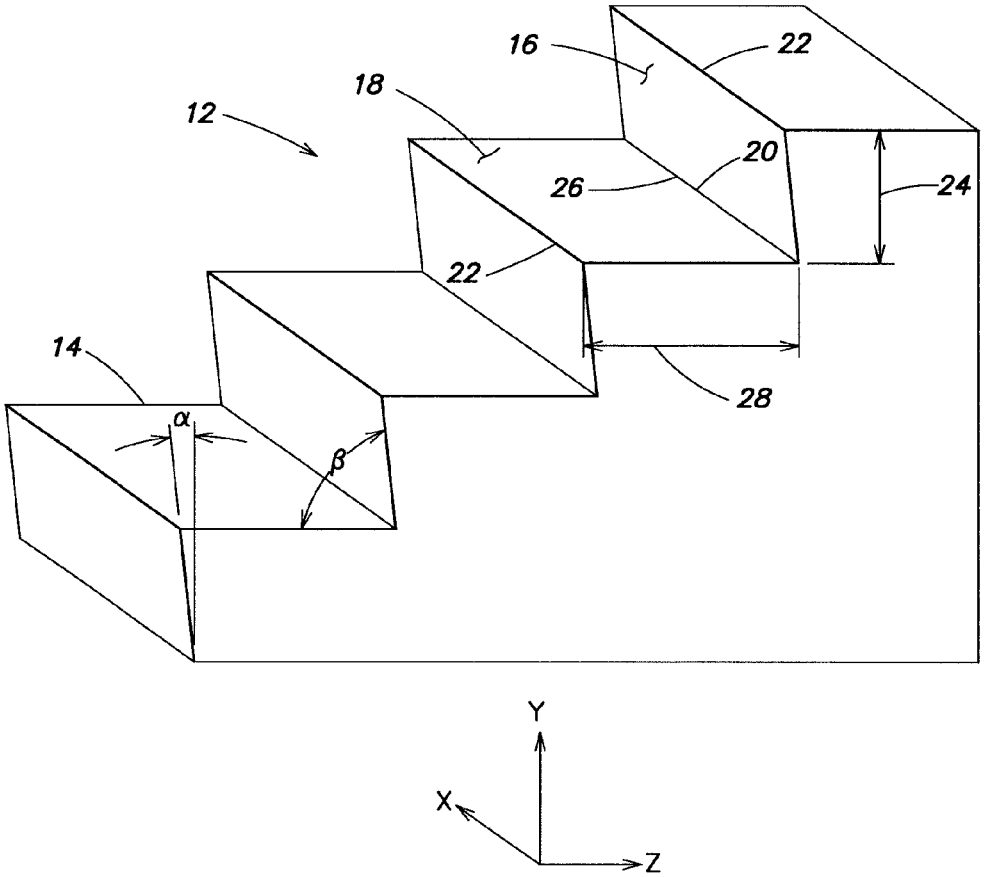
FIG. 1 (Prior Art)
FIG. 1 is a perspective view of a prior art concrete stairway

Referring to FIG. 2, each adjustable lateral brace 36 extends, for example, horizontally (e.g., along the x-axis) between two ends 132,134. Each adjustable lateral brace 36 includes a plurality of rail fastener apertures 136 disposed along its length. An example of a suitable lateral brace is a length of the MQ series, slotted stainless steel channel manufactured by Hilti Corporation. The present invention, however, is not limited to any particular type of lateral brace. In the specific embodiment shown in FIG. 1, each adjustable lateral brace 36 is configured having an adjustable length. For example, each adjustable lateral brace 36 can include first and second brace members 137 and 139 that are slidably connected via a brace clamp 141.

Each riser panel 38 extends, for example, horizontally (e.g., along the x-axis) between two ends 138, 140. Each riser panel 38 has a height that is sized equal to the rise 24 for each respective step 14 to be formed. Each riser panel 38 includes a plurality of panel leg fastener apertures (not shown) disposed along its length. Typically, the riser panels 38 are constructed from wood planks; however, the present invention is not limited thereto.

The stringer rails 30 are disposed at an angle $\phi$ relative to the horizontal plane (i.e., the x-z plane). The stringer rails 30 on each side of the adjustable concrete form 10 can be attached to an adjacent wall 142, 144, or immobilized in any other suitable manner. For example, the stringer rails 30 can be attached to the adjacent wall 142, 144 via L-brackets 154 bolted to the rails 30. The adjustable lateral braces 36 are disposed substantially perpendicularly across each of the stringer rails 30. Each adjustable lateral brace 36 is attached to the mid section 46 of each stringer rail 30, for example, via a bolt 146 extending through respective rail and stringer fastener apertures 136, 52. Advantageously, in this configuration, the adjustable lateral braces 36 can serve dual purposes of (i) laterally securing and positioning the stringer rails 30, and (ii) providing staging such that a user can position himself over the adjustable concrete form 10 during the pouring and finishing of the stairs, using the brace 36 to support his weight.

Referring still to FIG. 2, each riser bracket 32 is disposed along the length 44 of one of the respective stringer rails 30. Typically, each riser bracket 32 is disposed a first distance 148 from each adjacent riser bracket 32; however, the present invention is not limited to such an equidistant spacing. The first distance 148 between adjacent riser brackets 32 is sized as a function of the run 28 for each tread 18 to be formed. Referring now to FIG. 3, the panel leg 68 is disposed a second distance 150 from the support leg 70 in each respective riser bracket 32. The second distance 150 between respective panel and support legs 68 and 70 is chosen to establish the angles α and β (see FIG. 1) for each step 14 to be formed (i.e., the offset angle between the riser 16 to be formed and the vertical plane, and the offset angle between the tread 18 and the riser 16 to be formed). The angle β (see FIG.1) is also function of the first distance 148 between adjacent riser brackets 32 and, more specifically, the vertical distance 152 between respective ends 74 of adjacent panel legs 68.

The riser panels 38 are typically disposed perpendicularly across each of the stringer rails 30. Each riser panel 38 is attached to the panel legs 68 of respective riser brackets 32 on each stringer rail 30, for example, via screws (not shown) respectively extending through the panel leg and into the riser panel 38.

The fasteners 34 can operate in a plurality of modes of operation. For example, during a first mode of operation (e.g., when the adjustable concrete form 10 is being setup or disassembled), the bolts 132 for the fasteners 34 are loosened such that the riser bracket legs 68, 70 can be slid along the stringer rail 30 into or out of the aforesaid configuration. In another example, during a second mode of operation (e.g., once the angles α and β and the first and the second distances for each step 14 have been set), the bolts 132 for the fasteners 34 can be tightened to securely attached (e.g., clamp) the fasteners 34 to the stringer rails 30. Each of the riser brackets 32, therefore, are fixed relative to the stringer rails 30 and are ready to support the weight of concrete poured into the adjustable concrete form 10.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. An apparatus for forming steps for a concrete stairway, wherein each step has a rise and a run, the apparatus comprising:

a rail having a lengthwise-extending channel;

one or more riser brackets, each riser bracket having a panel leg and a support leg, wherein one end of the support leg is attached to the panel leg; and a plurality of fasteners selectively slidable within the rail channel, wherein one of the fasteners attaches the panel leg to the rail and another of the fasteners attaches the support leg to the rail;

wherein each fastener is configurable in a first mode where the fastener is slidably attached to the rail; and wherein each fastener is configurable in a second mode where the fastener is fixedly attached to the rail.

2. The stair form of claim 1, wherein the support leg is pivotally attached to the panel leg, and wherein in the first mode the fasteners are respectively pivotally attached to the panel leg and the support leg.

3. The stair form of claim 2, wherein the panel leg is positionable to mount a riser panel in a vertical plane, or at an angle α from vertical.

4. The stair form of claim 3, wherein the angle α is complementary to an angle β, which angle β is formed between a run line extending between adjacent steps in the stairway and the panel leg, and which angle β is less than 90 degrees.

5. The stair form of claim 1, wherein the each of the fasteners selectively slidable within the rail channel is adapted to be fixed to the rail.

6. An apparatus for forming steps within a concrete stairway, wherein each step has a rise and a run, the apparatus comprising:

at least a first rail and a second rail, each rail having a lengthwise-extending channel;

one or more riser brackets, each riser bracket having a panel leg and a support leg, wherein one end of the support leg is attached to the panel leg; and a plurality of fasteners selectively slidable within the channel of the first or second channel, wherein one of the fasteners attaches the panel leg of one of the brackets to one of the rails and another of the fasteners attaches the support leg of the same bracket to the respective rail;

wherein each fastener is configurable in a first mode where the fastener is slidably attached to the rail; and wherein each fastener is configurable in a second mode where the fastener is fixedly attached to the rail.

7. The apparatus of claim 6, wherein the support leg of one of the brackets is pivotally attached to the panel leg of the bracket, and wherein in the first mode the fasteners are respectively pivotally attached to the panel leg and the support leg.

8. The apparatus of claim 7, wherein the panel leg of each riser bracket is positionable to mount a riser panel in a vertical plane, or at an angle α from vertical.

9. The apparatus of claim 8, wherein the angle α is complementary to an angle β, which angle β is formed between a run line extending between adjacent steps in the stairway and the panel leg, and which angle β is less than 90 degrees.

10. The apparatus of claim 6, wherein the each of the fasteners selectively slidable within the rail channel is adapted to be fixed to the rail.

11. The apparatus of claim 6, further comprising at least one stringer extending between rails.

* * * * *